US007378795B2

(12) United States Patent
Hur et al.

(10) Patent No.: US 7,378,795 B2
(45) Date of Patent: May 27, 2008

(54) PLASMA DISPLAY PANEL

(75) Inventors: Min Hur, Suwon-si (KR); Soon-Sung Suh, Suwon-si (KR); Hoon-Young Choi, Suwon-si (KR); Young-Do Choi, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 269 days.

(21) Appl. No.: 11/258,148

(22) Filed: Oct. 26, 2005

(65) Prior Publication Data

US 2006/0087237 A1 Apr. 27, 2006

(30) Foreign Application Priority Data

Oct. 27, 2004 (KR) ..... 10-2004-0086154

(51) Int. Cl.
*H01J 17/49* (2006.01)

(52) U.S. Cl. ..... 313/582; 313/584

(58) Field of Classification Search ..... 313/582–586, 313/631, 491

See application file for complete search history.

(56) References Cited

FOREIGN PATENT DOCUMENTS

JP 2003-338247 A1 11/2003
KR 1020010107185 A1 12/2001

*Primary Examiner*—Vip Patel
(74) *Attorney, Agent, or Firm*—H.C. Park & Associates, PLC

(57) ABSTRACT

An improved plasma display panel is provided that may reduce a discharge firing voltage while simultaneously improving discharge efficiency. The plasma display panel may include a first substrate substantially paralleling an opposite second substrate across a predetermined gap, wherein the gap is divided into a discharge cell. A phosphor layer may be formed in the discharge cell. An address electrode may be formed on the first substrate to extend along a first direction. A first electrode and second electrode may be formed on the first substrate, and a degree that a portion of at least one of the first electrode or the second electrode proximate the second substrate protrudes toward a center of the discharge cell may differ from a degree that another portion of the at least one of the first electrode or the second electrode proximate the first substrate protrudes toward the center of the discharge cell.

20 Claims, 13 Drawing Sheets

PLASMA DISPLAY PANEL

CROSS-REFERENCE TO RELATED APPLICATIONS

This application claims priority to and the benefit of Korean Patent Application No. 10-2004-0086154 filed in the Korean Intellectual Property Office on Oct. 27, 2004, the entire content of which is incorporated herein by reference in its entirety.

BACKGROUND OF THE INVENTION

1. Field of the Invention

The invention relates to a plasma display panel, and more particularly, to a plasma display panel that can induce plasma sustain discharge via an opposed electrode discharge.

2. Description of Related Art

A plasma display panel (PDP) displays an image using visible light emitted from phosphor material that is bombarded with vacuum ultraviolet (UV) rays. The UV rays are emitted from a plasma formed when a gas within the PDP is energized via a discharge of electricity. PDPs can be used to manufacture large high resolution screens, and have thus been highlighted as the next generation of display devices.

A conventional plasma display panel incorporates three-electrodes arranged in a predetermined pattern. This structure generally includes a front substrate having two display electrodes formed thereon and a rear substrate that is spaced apart from the front substrate at a predetermined distance and on which address electrodes are formed. The space between both substrates is divided into a plurality of discharge cells by barrier ribs, a phosphor layer formed in the discharge cell faces the rear substrate, and a discharge gas is injected into each discharge cell.

As mentioned above, transparent display electrodes are formed on the same surface of the front substrate, while address electrodes are formed on the rear substrate. Thus, in the conventional plasma display panel, the address discharge occurs using opposing pairs of address and display electrodes, but the sustain discharge occurs using only surface-adjacent display electrodes. Thus, the address discharge used to select a pixel for illumination uses an opposed-electrode discharge, while the sustain discharge used to illuminate the selected pixel to a desired brightness uses a same-surface electrode discharge.

In the conventional PDP, a distance between a display electrode and its corresponding address electrode is generally greater than a distance between two adjacent display electrodes. The discharge firing voltage of the address discharge, however, is less than the discharge firing voltage of the display discharge because the address discharge is induced using an opposed discharge rather than a surface discharge.

On the other hand, the discharge area is divided into a sheath region and a positive column region. The sheath region is a non-emitting region surrounding around a dielectric layer or an electrode and most of the voltage is consumed in the sheath region. The positive column region is a region that can actively generate plasma discharge at a very low voltage. Accordingly, the efficiency of the plasma display panel may be increased by increasing the positive column region. Since the length of the sheath region is not related to the discharge gap, a method of enlarging a discharge length may be used as a method of enlarging the positive column region. Increasing the discharge gap is problematic, however, because increasing the discharge gap also increases the discharge firing voltage.

Accordingly, a conventional plasma display panel cannot simultaneously achieve a low discharge firing voltage and high discharge efficiency.

SUMMARY OF THE INVENTION

The invention may provide a plasma display panel (PDP) that reduces a discharge firing voltage and/or increases operating efficiency. The discharge firing voltage may be reduced by discharging opposing display electrodes to induce a sustain discharge in a small discharge gap.

In one embodiment, a PDP may include a first substrate and a second substrate that oppose each other at a predetermined gap. A space between the first and second electrodes may be divided into at least one discharge cell. A phosphor layer may be formed in each discharge cell. An address electrode may be formed on the first substrate to extend along a first direction (y-direction). A first electrode and a second electrode that are each electrically insulated from the address electrode by an intervening dielectric layer may be formed on the first substrate to extend along a second direction (x-direction) that intersects the first direction.

The first electrode and the second electrode may be formed on opposite sides of each discharge cell with a space interposed therebetween. Further, the distance that a bottom portion of each electrode (proximate the second substrate) protrudes toward a central portion of each discharge cell may differ from the distance that a top portion of each electrode (proximate the first substrate) protrudes toward the central portion of each discharge cell.

BRIEF DESCRIPTION OF THE DRAWINGS

These and/or other aspects and advantages of the invention will become apparent and more readily appreciated from the following description of the embodiments, taken in conjunction with the accompanying drawings.

DESCRIPTION OF THE EMBODIMENTS

Figure 1:
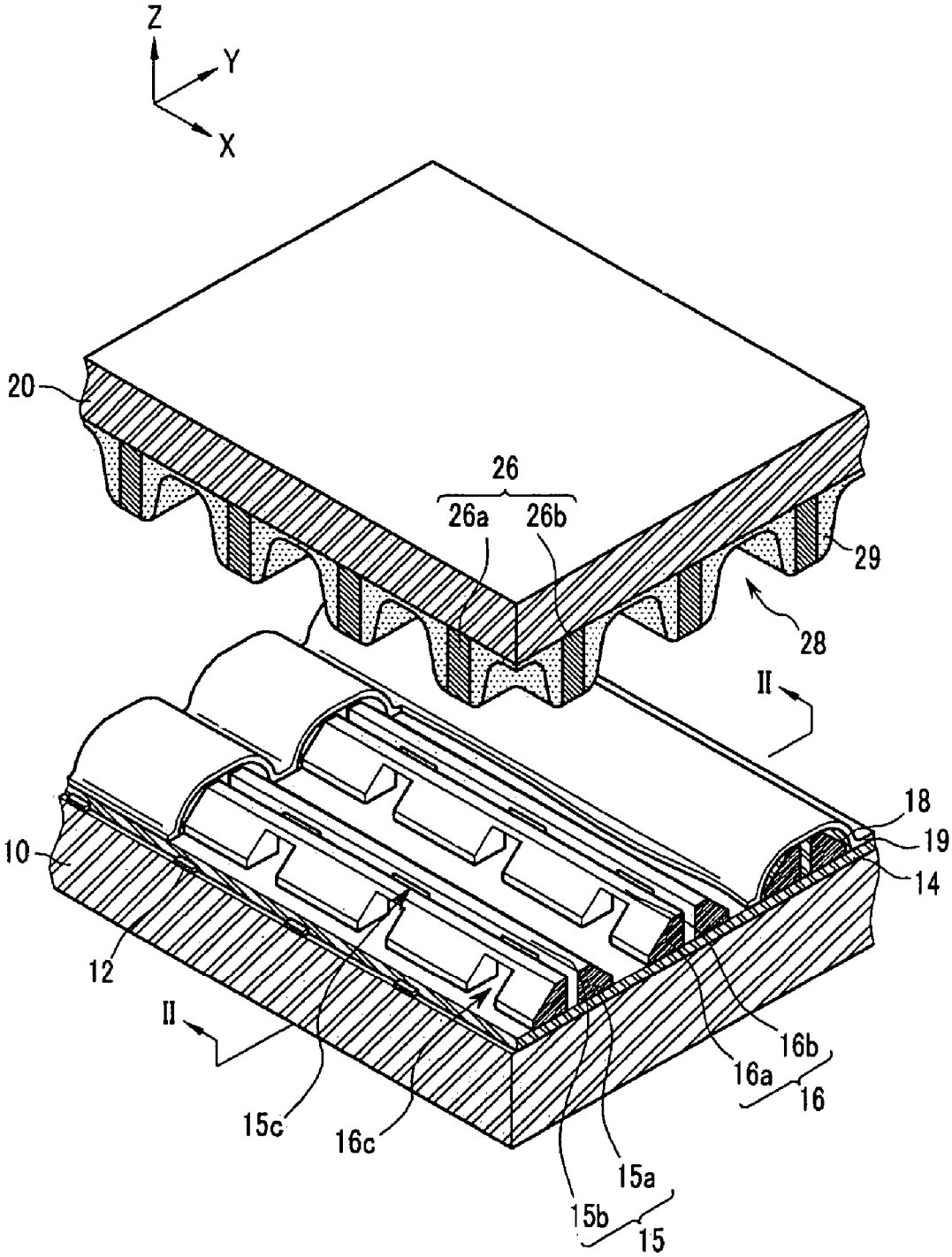
FIG. 1 is a partially exploded perspective view of a plasma display panel manufactured according to a first embodiment of the invention.
Figure 2:
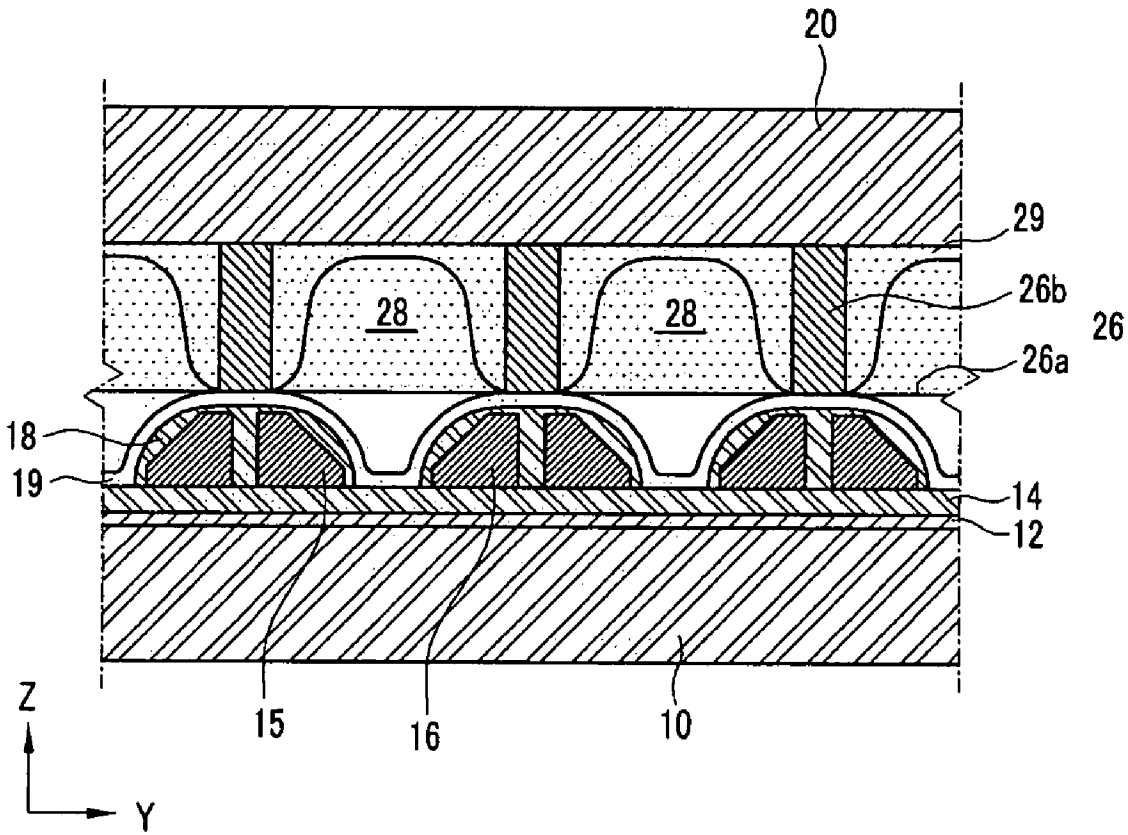
FIG. 2 is a partial cross-sectional view taken along a line II-II of FIG. 1.
Figure 3:
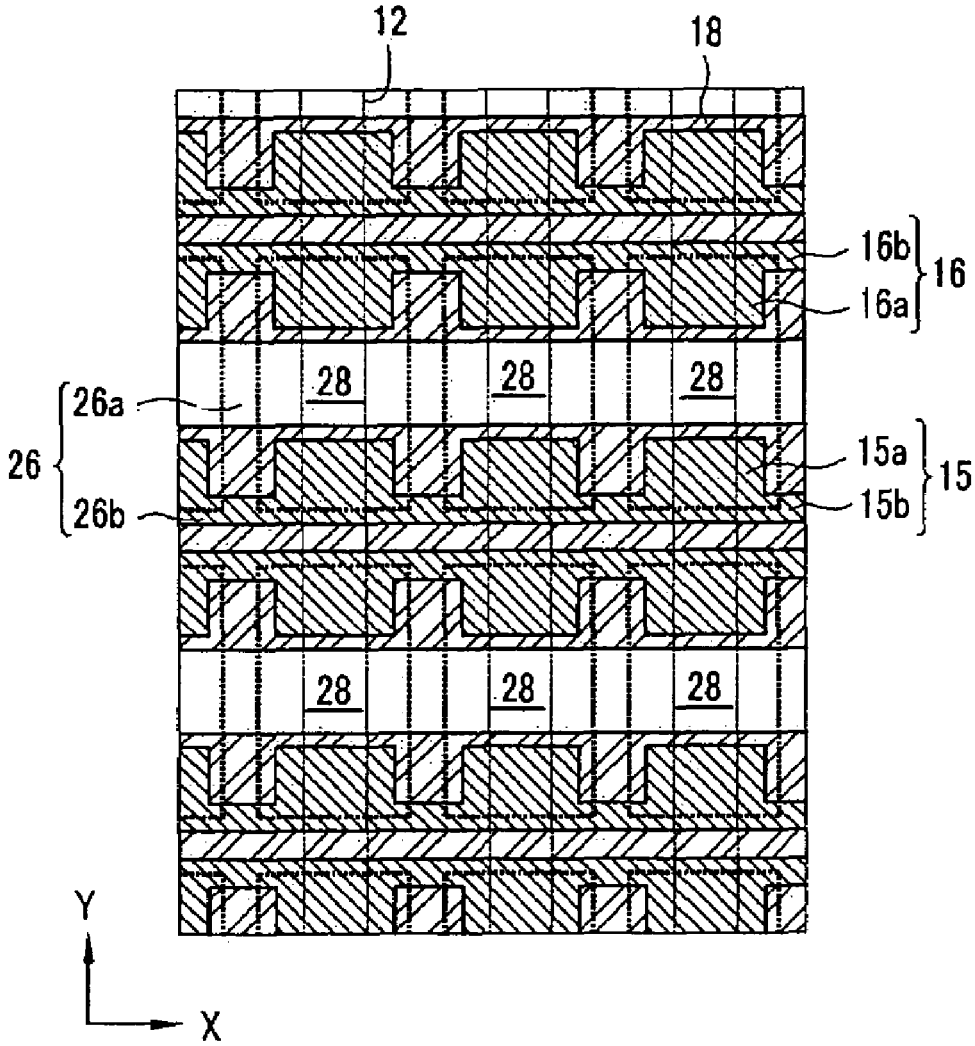
FIG. 3 is a partial plan view of the plasma display panel of FIG. 1.

FIG. 1 is a partially exploded perspective view of a plasma display panel manufactured according to a first embodiment of the invention. FIG. 2 is a partial cross-sectional view taken along a line II-II of FIG. 1. FIG. 3 is a partial plan view of the plasma display panel of FIG. 1.

Referring to FIG. 1, a plasma display panel manufactured according to the first embodiment of the invention may include a rear substrate 10 and a front substrate 20 that may be positioned substantially parallel each other at a predetermined interval. A space between the rear substrate 10 and the front substrate 20 may be divided into a plurality of discharge cells 28 by barrier ribs 26. The barrier ribs 26 may be formed on an inner surface of the front substrate 20.

On one surface of the rear substrate 10 which faces the front substrate 20, address electrodes 12 extend along a first direction (y-axis direction) and a first dielectric layer 14 formed on the entire surface of the rear substrate 10 may cover the address electrodes 12. In the present embodiment, each of the address electrodes 12 may have a uniform line width and may be formed to have a straight-line shape.

A first electrode 15 and a second electrode 16 formed on the first dielectric layer 14 may be electrically insulated from the address electrodes 12 by the first dielectric layer 14. The first electrode 15 and the second electrode 16 may be formed along a second direction (x-axis direction) that intersects the first direction. In the present embodiment, each of the first electrode 15 and the second electrode 16 may be formed inside each discharge cell 28 on opposite sides thereof.

In use, the first electrode 15 and the second electrode 16 may participate in the sustain discharge; and any one of the first electrode 15 and the second electrode 16 may participate in an address discharge with the address electrode 12. However, since the role of each electrode may be varied according to an applied signal voltage, the invention is not limited to this.

When viewed from the end, each of the first electrode 15 and the second electrode 16 may have a substantially vertical top surface, and a top surface that projects substantially orthogonally outward from the top surface. Each electrode may further include a bottom surface projecting outward from and substantially orthogonally to the top surface. The bottom surface may be substantially parallel to the top surface, but an end of the bottom surface may extend beyond an end of the top surface. Additionally, a front surface may project substantially orthogonally upwards from an end of the bottom surface. The front surface, which is shorter than the rear surface, may connect to the top surface via an angled surface that slopes downward from an end of the top surface to an end of the front surface.

The electrodes 15 and 16 may be positioned back-to-back with a gap between their adjacent rear surfaces. A longitudinal axis of each electrode may be substantially parallel to the other and may extend along the x-axis (second direction).

When viewed from the side, each of the first electrode 15 and the second electrode 16 may be seen to include subparts. For example, a plurality of spaced-apart gaps 15*c* and 16*c* may separate each electrode 15 and 16 into a plurality of first portions 15*a* and 16*a*. Each gap 15*c* and 16*c* may comprise a notch in the bottom surface of each electrode 15 and 16. Additionally, each gap may extend from the front surface to the rear surface of each electrode 15 and 16, and also vertically upwards from the bottom surface.

Beginning at the rear surface and projecting towards the front surface for a distance longer than the top surface of each electrode 15 and 16, each gap 15*c* and 16*c* may extend vertically upward for a portion of the height of each electrode's rear surface. In this manner, connecting portions 15*b* and 16*b* may traverse gaps 15*c* and 16*c* to connect the top surfaces of each electrode 15 and 16. Additionally, the remainder of the first portions 15*a* and 16*a* may be separated by the gaps 15*c* and 16*c*.

As shown in FIG. 1, electrode 15 and electrode 16 may be positioned along opposite sides of each discharge cell 28, such that the gaps 15*c* and 16*c* substantially align with centers of a first barrier ribs member 26*a* (along the y-direction), and such that the gaps between the adjacent rear surfaces of adjacent electrodes 15 and 16 may substantially align with a center of a second barrier rib member 26*b* (along the x-direction). In this manner, each discharge cell 28 may include a first portion 15*a* of electrode 15 positioned along one side thereof, and a first portion 16*a* of electrode 16 positioned along an opposite side thereof. Additionally, each first portion 15*a* and each first portion 16*a* may project from the side of each discharge cell 28 toward a central axis thereof. Further, the front surfaces of each first portion 15*a* may be separated from the front surfaces of each first portion 16*a* by a channel that runs along each discharge cell's central axis.

Since the first electrode 15 and the second electrode 16 oppose each other in each discharge cell 28, the sustain discharge generated between the first electrode 15 and the second electrode 16 can be induced via opposed discharge. Accordingly, the discharge firing voltage may be less than a discharge firing voltage of a conventional plasma display panel that induces the sustain discharge via surface discharge. The first electrode 15 and the second electrode 16 are further described below with reference to FIG. 4.

Referring again to FIG. 1, a second dielectric layer 18 may be formed to individually surround each adjacent pair of back-to-back first and second electrodes 15 and 16. As shown in FIG. 3, the second dielectric layer 18 may extend along the second direction (x-direction) over the length of adjacent electrodes 15 and 16, and may extend in the first direction (y-direction) over the width of each pair of adjacent electrodes 15 and 16. That is, the second dielectric layer 18 may leave a discharge space between a first electrode 15 formed on one side of each discharge cell 28 and a second electrode 16 formed on the opposite side of each discharge cell 28.

Mis-discharge is reduced or prevented because each pair of adjacent electrodes 15 and 16 may be separated from each other by a gap that is filled with the material comprising the second dielectric layer 18. Mis-discharge is further avoided because the first portion 15*a* of the first electrode 15 is also separated from the first portion 16*a* of the second electrode 16 by the material comprising the second dielectric layer 18.

Referring to FIGS. 1 and 2, an MgO protective film 19 for covering a portion of the first dielectric layer 14 and the entirety of the second dielectric layer 18 may be formed on the entire surface of the rear substrate 10. The MgO protective film 19 prevents the address electrodes 12, the display electrodes 15 and 16, the first dielectric layer 14, and the second dielectric layer 18 from being damaged by collision with ions during plasma discharge. Also, the discharge efficiency increases when the protective film is formed of MgO because MgO has a high secondary electron emission coefficient. As shown in FIGS. 1 and 2, portions of the MgO protective film 19 may be formed in the central spaces of the discharge cells 28.

Referring to the front substrate 20 shown in FIG. 1, a barrier rib 26 may be formed thereon to divide the space between the front substrate 20 and the rear substrate 10 into one or more discharge cells 28. More particularly, the barrier rib 26 may be located between the front substrate 20 and the second dielectric layer 18 surrounding each adjacent pair of first electrode 15 and second electrode 16. The barrier rib 26 may include a first barrier rib member 26*a* formed along the first direction and a second barrier rib member 26*b* formed along the second direction to intersect the first barrier rib member 26*a*. Of course, this particular barrier rib configuration is exemplary only, and the invention may include other configurations.

For example, a stripe-type barrier rib structure that includes only barrier rib members formed along the first direction may be used. Additionally, the barrier rib members 26*a* and 26*b* may each have geometrical shapes that differ from the examples shown in the Figures and/or described herein. Such barrier rib members may also be included in the scope of the invention.

In the invention, as another example, after forming a dielectric layer (not shown) on the front substrate 20, the barrier rib 26 can be formed on the dielectric layer. Moreover, one or more layers may be interposed between the barrier rib 26 and the front substrate 20.

In each discharge cell 28, red, blue, and green phosphor layers 29 for absorbing ultraviolet rays and emitting visible light may be formed, and discharge gas (for example, a gas mixture including xenon (Xe) and neon (Ne)) may be filled to generate the plasma discharge. In one embodiment, a phosphor layer 29 may be formed on the surface of the barrier rib 26 and on the bottom surface adjacent to the front substrate 20 between the barrier ribs 26.

As mentioned above, in the present embodiment, the address electrode 12, the first electrode 15, and the second electrode 16 which participate in the discharge may be formed on the rear substrate 10. By forming the address electrode 12 and the first electrode 15 participating in the address discharge on the same rear substrate 10, the path of the address discharge can be reduced, and thus the discharge firing voltage of the address discharge can also be reduced. On the other hand, forming the phosphor layer 29 on the front substrate 20 may prevent unevenness of the discharge firing voltage which may be generated by different permittivity of the different color phosphor layers.

Further, since all the electrodes 12, 15, and 16 participating in the discharge are not located on the front substrate 20, the transmissivity of the visible light generated by the plasma discharge can be improved. Also, because the first and second electrodes 15 and 16 may be composed of only a metal material having excellent conductivity, the manufacturing process may be simplified and the manufacturing cost may be more reduced, compared to the costs and time associated with manufacturing a conventional plasma display panel that includes both a transparent electrode and a metal electrode.

Figure 4:
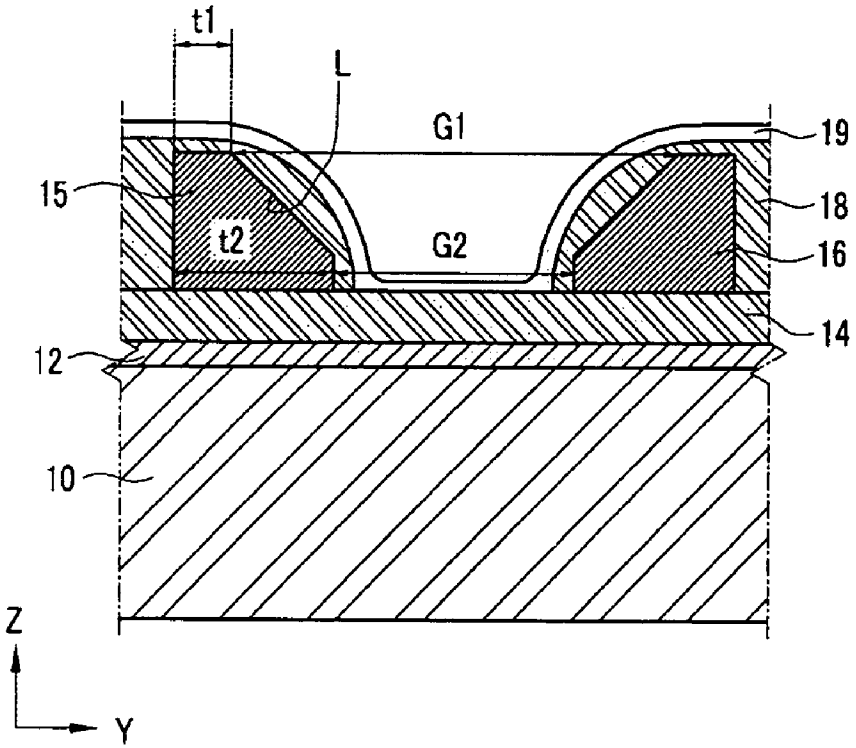
FIG. 4 is a partial cross-sectional view illustrating a rear structure of the plasma display panel of FIG. 1.

FIG. 4 is a partial cross-sectional view illustrating a rear structure of the plasma display panel of FIG. 1. As shown, the rear substrate 10 may include address electrode 12 and the first and second electrodes 15 and 16 formed thereon.

Referring to FIG. 4, a partially assembled plasma display panel may include a rear substrate 10 on which an address electrode 12 is formed to extend longitudinally in a first direction (y-direction). The address electrode 12 is covered with a first dielectric layer 14. A first electrode 15 and a second electrode 16 are formed on the first dielectric layer 14 to extend substantially parallel each other in a second direction (x-direction). More particularly, a front region of the first electrode 15 may face a front region of the second electrode across a space that varies in width when measured at two or more different heights from the first dielectric layer 14. A second dielectric layer 18 may encapsulate each adjacent first electrode and second electrode pair. A MgO protective film 19 may be formed over the second dielectric layers 18, and a portion of the MgO protective film 19 may both contact the first dielectric layer 14 to separate adjacent second dielectric layers 18.

Both the first electrode 15 and the second electrode 16 may have a five-sided shape, and each electrode may be a mirror image of the other. More particularly, each electrode 15 and 16 may include a top portion of width t1, and a bottom portion of width t2, which is wider than t1. Thus, widths t2 of the bottom portions of electrodes 15 and 16 that adjoin the first dielectric layer 14 formed on the rear substrate 10 may be wider than the widths t1 of the electrodes' top portions that are positioned proximate a front substrate (not shown). As a result, edges of the top surfaces of electrodes 15 and 16 may be separated by a gap G1, and the bottom first surfaces of the electrodes 15 and 16 may be separated by a smaller gap G2. Stated differently, the bottom portion of each electrode 15 and 16 may protrude further toward the center of each discharge cell than a top portion of each electrode.

Additionally, the opposing front portions of the first and second electrodes 15 and 16 may be configured to form a slanted surface L. The slanted surface L may begin at edges of the top surfaces of the electrodes 15 and 16 and slope downwards toward the center of each discharge cell 28

Configuring opposing electrodes 15 and 16 to have a narrow gap G2 between their opposing bottom portions and a wider gap G1 between their opposing top portions may afford several advantages. For example, initiating sustain discharge in the short gap G2 may reduce a discharge firing voltage. Moreover, the high discharge efficiency afforded by the long gap G1 may permit a main discharge to be maintained in the gap G1 with reduced current and/or power consumption. Additionally, the slanted portions L of each electrode 15 and 16 may further enhance the PDP's operational characteristics by allowing the discharge initiated in the short gap G2 to be easily diffused into the long gap G1, thereby improving stability of a sustain discharge.

Hereinafter, modifications of the first embodiment of the invention will be described in detail. Since the basic structures of the modifications may be substantially similar to those of the first embodiment, the same or similar components are indicated by the same reference numerals, and their descriptions may be omitted.

Figure 5:
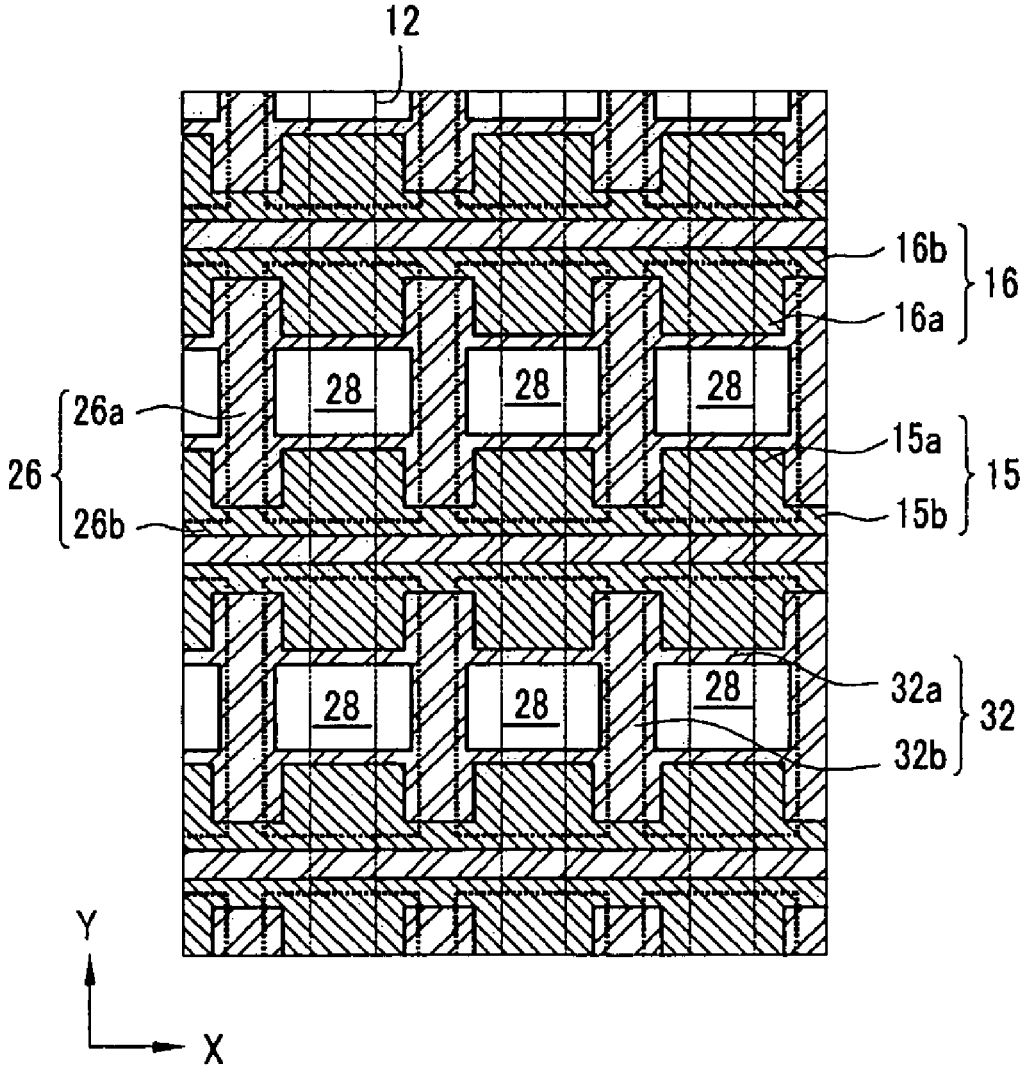
FIG. 5 is a partial plan view of a first modification of the first embodiment of the invention.

FIG. 5 is a partial plan view of a first modification of the first embodiment of the invention. Referring to FIG. 5, a second dielectric layer 32 may include a first dielectric layer portion 32*a* formed along the second direction and that surrounds the first and the second electrodes 15 and 16. The second dielectric layer 32 may further include a second dielectric layer portion 32*b* formed in the first direction to intersect the first dielectric layer portion 32*a*. The second dielectric layer portion 32*b* may be formed at a location proximate the first barrier rib member 26*a*. Use of the second dielectric layer 32 permits each discharge cell 28 to be divided into several independent sub-spaces. This configuration allows more accurate control of the discharge of each discharge cell 28.

Figure 6:
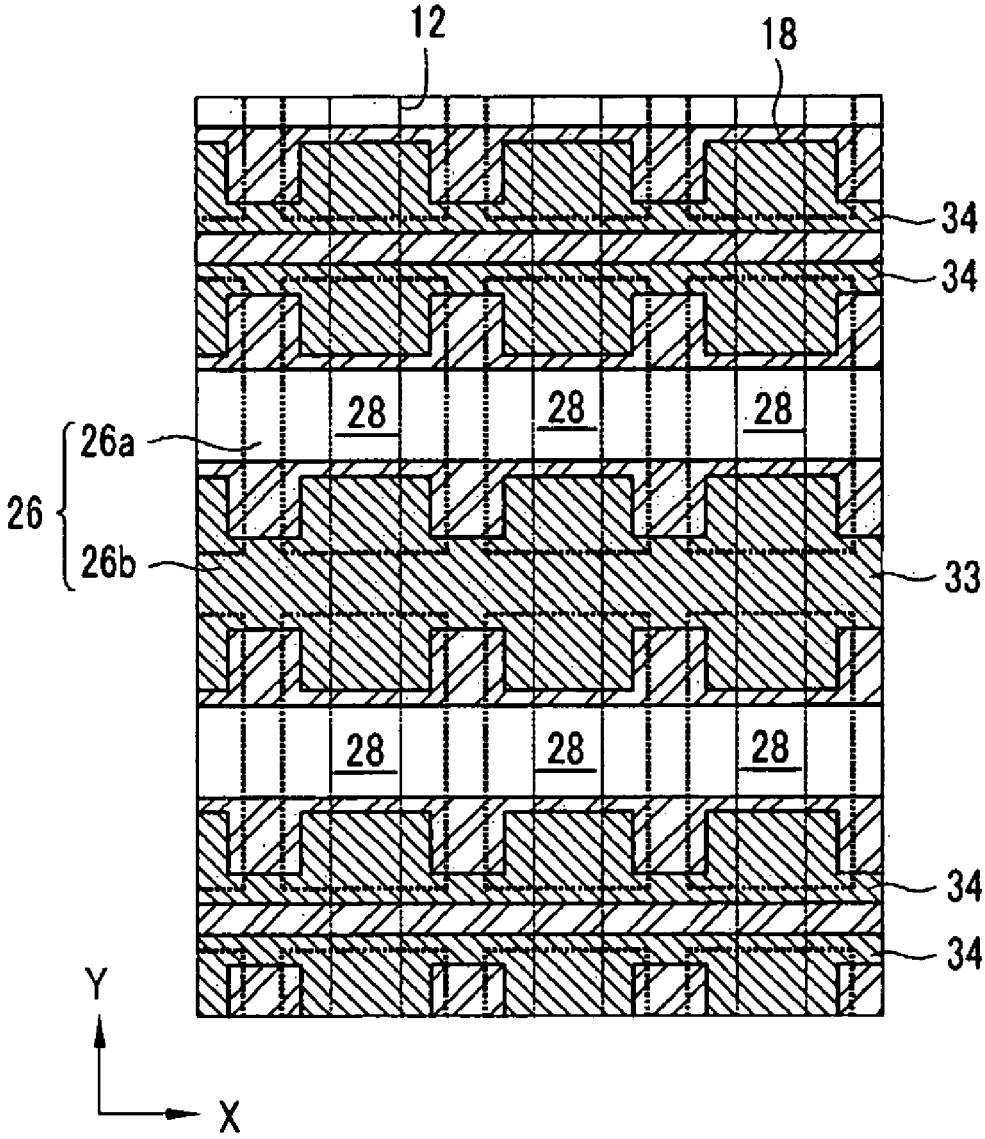
FIG. 6 is a partial plan view of a second modification of the first embodiment of the invention.

FIG. 6 is a partial plan view of a second modification of the first embodiment of the invention. Referring to FIG. 6, a double-sided electrode 33 may be flanked on either side by a discharge cell 28. A second electrode 34 may be formed in each discharge cell 28 and positioned on a side of each discharge cell 28 that is opposite a side of the electrode 33. To prevent mis-discharge, a pair of back-to-back second electrodes 34 may be separated by a layer of dielectric material.

In use, a voltage may be applied to second electrodes 34 and the address electrodes 12 to generate an address discharge. Similarly, a voltage may be applied to the first electrodes 33 and the second electrodes 34 to generate a sustain discharge.

Figure 7:
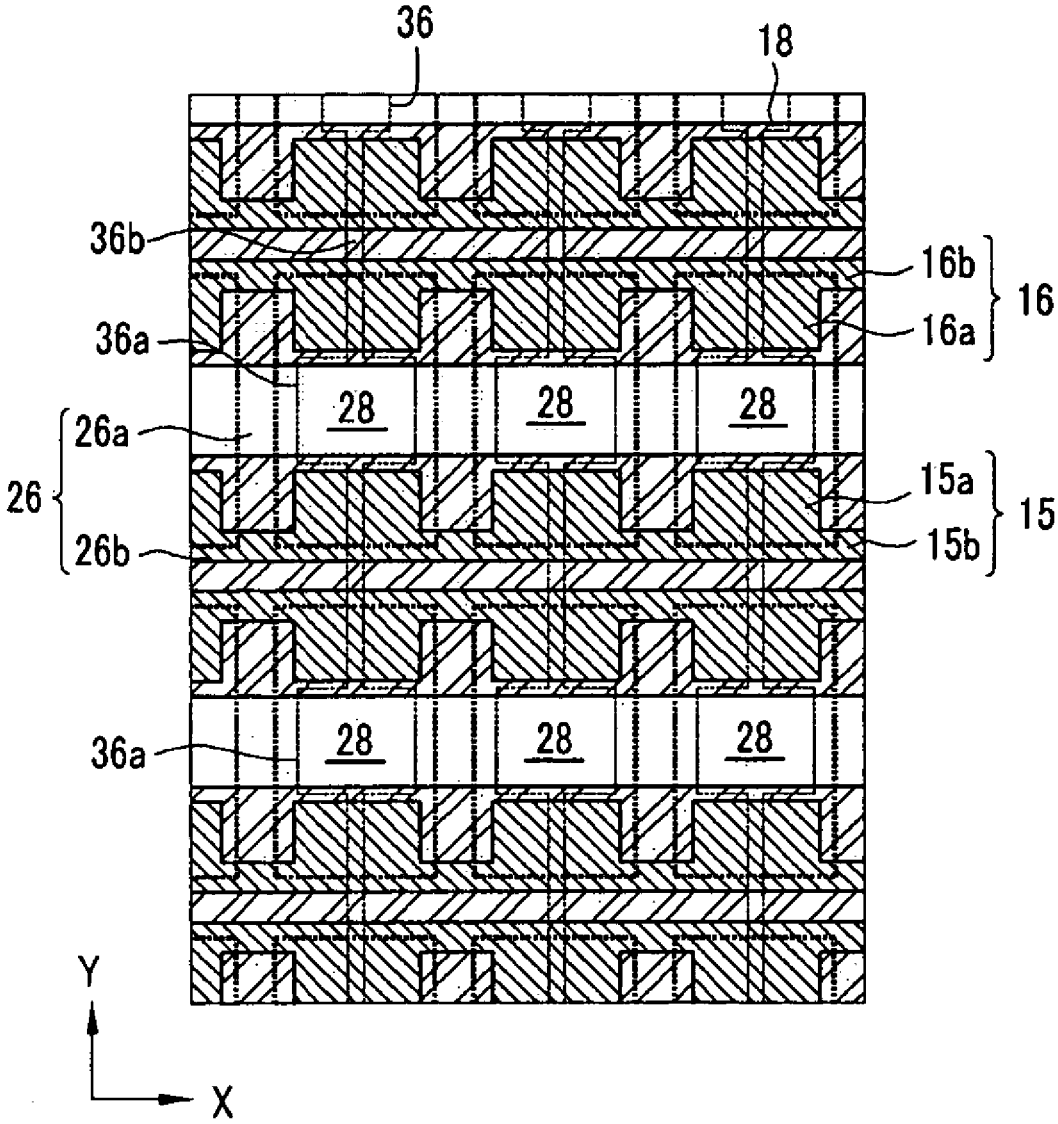
FIG. 7 is a partial plan view of a third modification of the first embodiment of the invention.

FIG. 7 is a partial plan view of a third modification of the first embodiment of the invention. As shown in FIG. 7, the address electrode 36 may include a protrusion 36*a* that is positioned to correspond with the space between the first electrode 15 and the second electrode 16. Additionally, the protrusion 36*a* may extend along the second direction (x-direction), on either side of the address electrode's longitudinal axis. Thus, each portion 36*a* may be about as wide as each first portion 15*a* or 16*a* of electrodes 15 and 16.

The configuration described above—an address electrode 36 having a narrow width 36*b* proximate the bottom portions of first portions 15*a* and 16*a* and a wide protrusion 36*a* proximate the center of each discharge cell 28—effectively reduces the area of the address electrode 36 at a portion that contributes little to an address discharge and effectively increases the area of the address electrode 36 at the region(s) of the discharge cells 28 that do participate in the address discharge. Consequently, the address discharge may occur more efficiently than in conventional PDP's.

Figure 8:
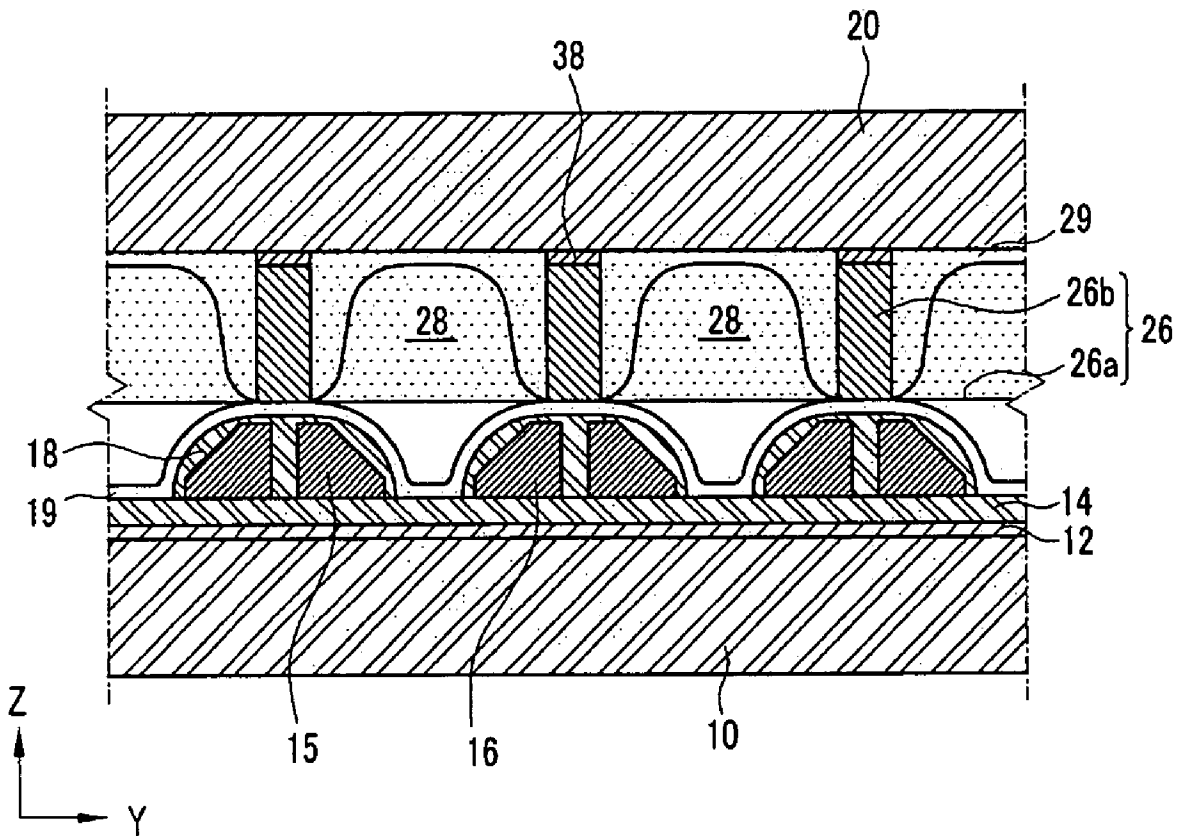
FIG. 8 is a partial cross-sectional view of a fourth modification of the first embodiment of the invention.

FIG. 8 is a partial plan view of a fourth modification of the first embodiment of the invention. As shown in FIG. 8, in the present modification, a black layer 38 corresponds to a portion in which the barrier rib 26 is formed between the front substrate 20 and the barrier rib 26. This black layer 38 prevents external light from being reflected to improve nominal contrast of the plasma display panel.

In the invention, where a dielectric layer (not shown) is formed on the front substrate 20 and the barrier rib 26 is formed on the dielectric layer, the black layer 38 may be formed between the barrier rib 26 and the dielectric layer, and this is included in the scope of the invention.

Figure 9:
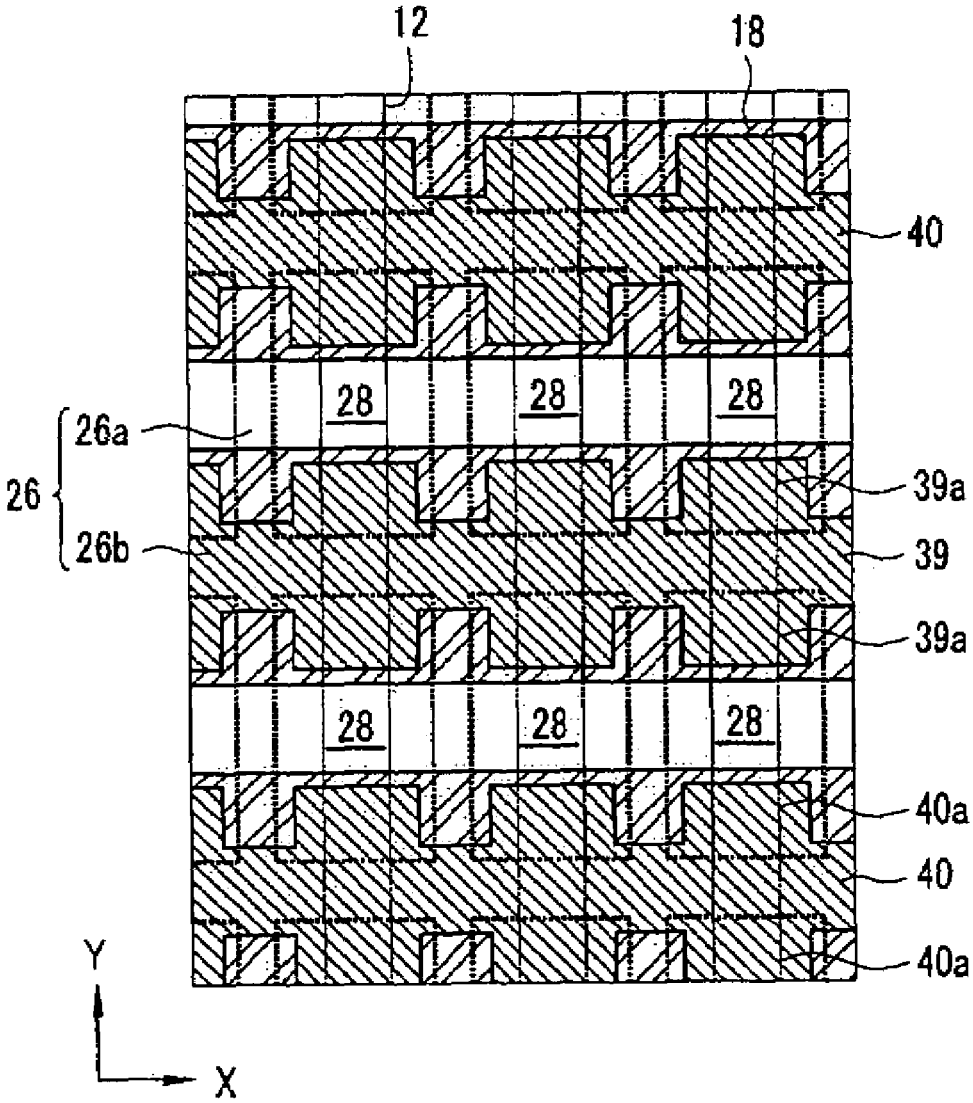
FIG. 9 is a partial plan view of a fifth modification of the first embodiment of the invention.

FIG. 9 is a partial plan view of a fifth modification of the first embodiment of the invention.

As shown in FIG. 9, an alternating series of dual-sided electrodes 39 and 40 may be formed on the rear substrate 10. The electrodes 39 and 40 may be positioned along barrier ribs 26*b* (FIG.1) such that opposite sides of each electrode project into a different discharge space 28. Thus, a sequence from top to bottom along the y-direction (first direction) of FIG. 9 may include a first side of an electrode 40, a second opposite side of electrode 40, a discharge space 28, a first side of a second electrode 39, a second opposite side of the second electrode 39, another discharge space 28, a first side of another electrode 40, a second opposite side of the another electrode 40, etc. Each side of each electrode 39 and 40 may include a projection 39*a* and 40*a*, respectively, that protrudes toward the center of the corresponding discharge space 28. Additionally, a pair of adjacent discharge cells 28 may be driven by one subpixel. Alternatively, each individual discharge cell 28 may be driven by one subpixel.

Hereinafter, the plasma display panel manufactured according to a second embodiment, a third embodiment, a fourth embodiment, and fifth embodiment of the invention will be described in detail. The basic structures of the second embodiment through the fifth embodiment of the invention may be substantially similar to the structure of the first embodiment, except that the shapes of the first electrodes and the second electrodes in the second, third, fourth, and fifth embodiments are different from the shapes of the first electrodes and the second electrodes in the first embodiment. In each embodiment, the same or similar components as the first embodiment are referenced using the same or similar reference numerals.

Figure 10:
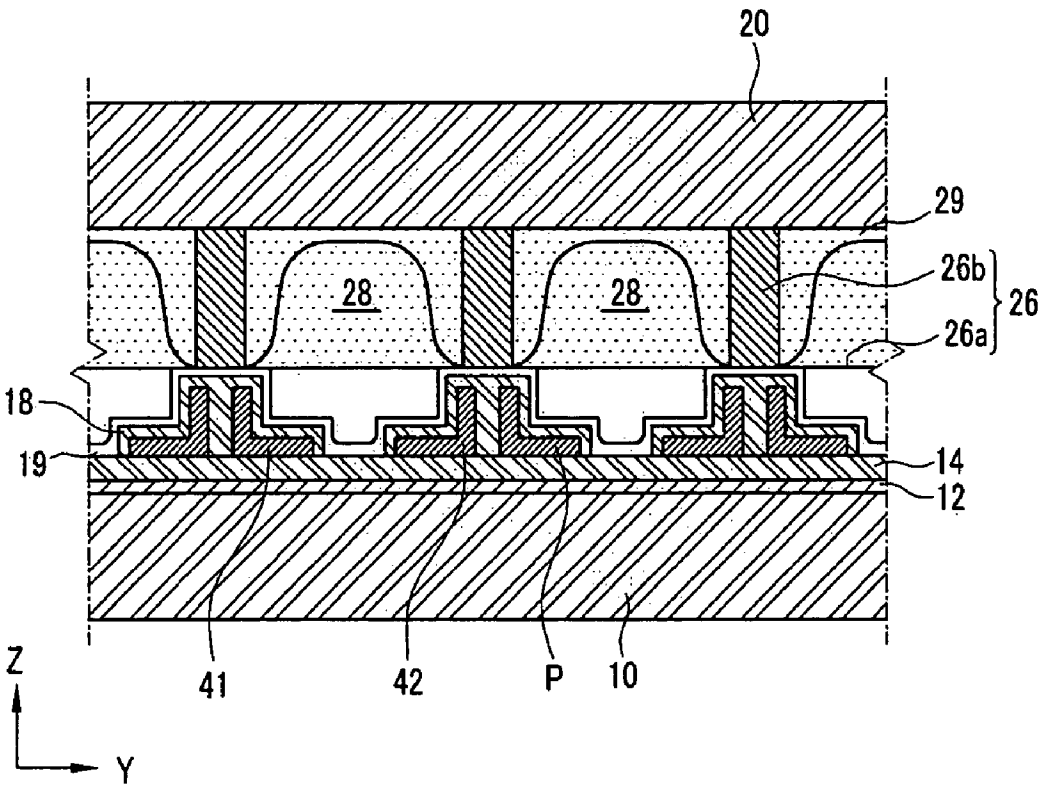
FIG. 10 is a partial cross-sectional view of a plasma display panel manufactured according to a second embodiment of the invention.

FIG. 10 is a partial cross-sectional view of a plasma display panel according to a second embodiment of the invention. In FIG. 10, first and second L-shaped electrodes 41 and 42 are positioned in each discharge cell 28 to oppose each other across a center space of each discharge cell 28. As shown in FIG. 10, the bottom surfaces of the protrusions P (the bottom portions of L-shaped electrodes 41 and 42) may face the rear substrate 10. The opposing top surfaces of electrodes 41 and 42 may be separated by a gap. A dielectric layer 18 may cover each pair of back-to-back electrodes 41 and 42, and may fill this gap. A MgO protective film 19 may coat the entire surface of the rear substrate 10. Use of the L-shaped electrodes 41 and 42 provides a short gap close to the rear substrate 10 and have a long gap close to the front substrate 20. Accordingly, the short gap discharge permits a reduced discharge firing voltage, and the long gap simultaneously (or substantially simultaneously) improves discharge efficiency.

Figure 11:
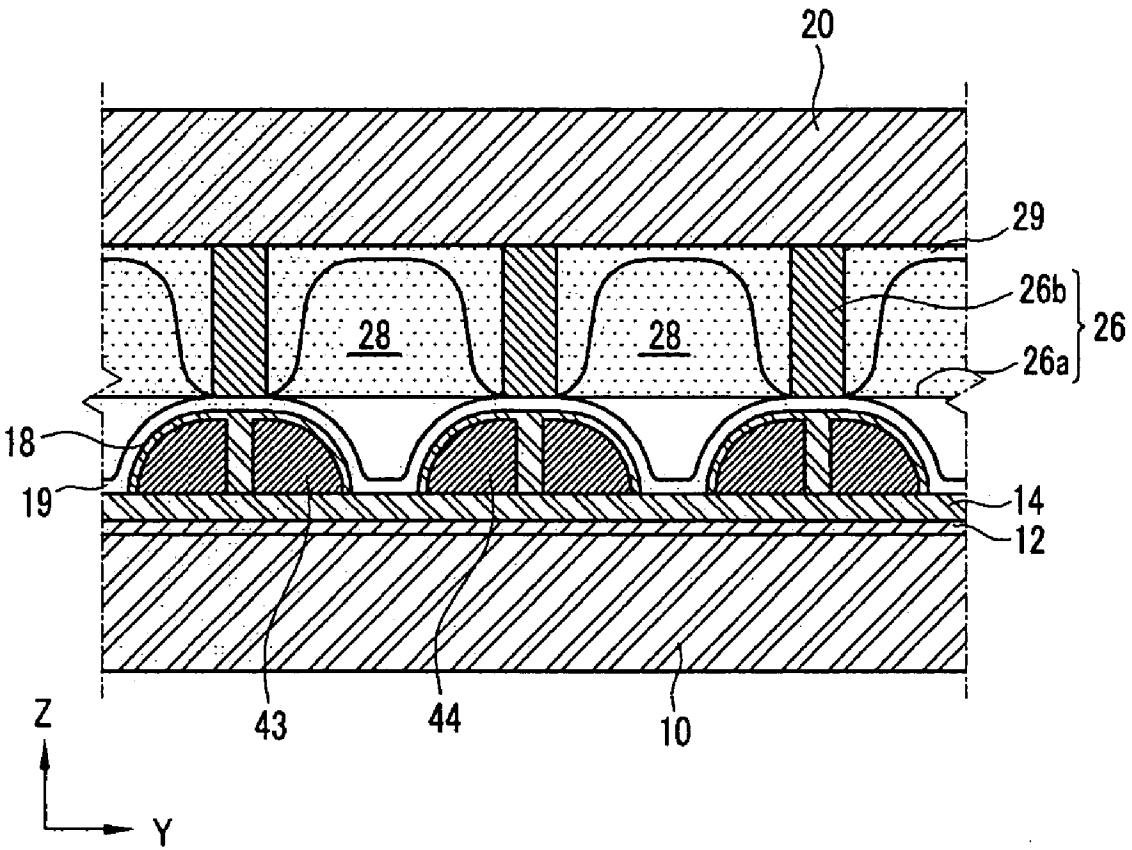
FIG. 11 is a partial cross-sectional view of a plasma display panel manufactured according to a third embodiment of the invention.

FIG. 11 is a partial cross-sectional view of a plasma display panel manufactured according to a third embodiment of the invention. In this embodiment, the first and second electrode 43 and 44 may be positioned in each discharge cell 28 to oppose each other across a center of each discharge cell 28. As shown in FIG. 11, the opposing interior surfaces of the first and second electrodes 43 and 44 may be curved. Thus, the portions of the electrodes 43 and 44 facing the rear substrate 10 may protrude further toward the center of the discharge cell 28 than other portions of the electrodes 43 and 44 that face the front substrate 20.

This configuration permits creation of a short gap discharge in a portion adjacent the rear substrate 10. The short gap discharge is then diffused into the main discharge region of the portion adjacent the front substrate 20. In this manner, the discharge efficiency is improved while the discharge firing voltage is reduced.

Figure 12:
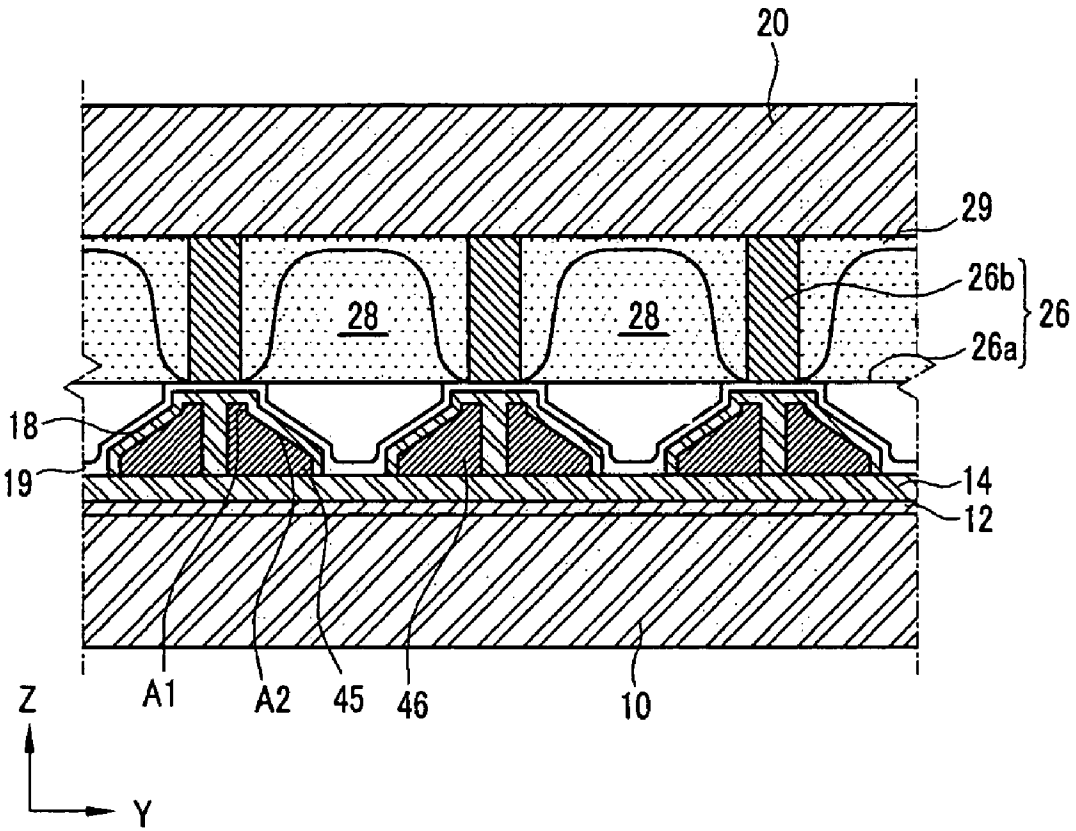
FIG. 12 is a partial cross-sectional view of a plasma display panel manufactured according to a fourth embodiment of the invention.

FIG. 12 is a partial cross-sectional view of a plasma display panel manufactured according to a fourth embodiment of the invention. Referring to FIG. 12, the first and second electrode 45 and 46 may be positioned in each discharge cell 28 to oppose each other across a center of each discharge cell 28. Each electrode 45 and 46 may include a first opposite surface A1 facing the front substrate 20 and a second opposite surface A2 located closer to the rear substrate 10 than the first opposite surface A1. The first opposite surface A1 may comprise a surface substantially perpendicular to the first direction, and the second opposite surface A2 may comprise a sloped surface. In such a configuration, a portion of each of the first and second electrodes 45 and 46 proximate the rear substrate 10 may protrude further toward the center of each discharge cell 28 than a portion of each electrode 45 and 46 proximate the front substrate 20.

Accordingly, when discharge is initiated in a portion adjacent to the rear substrate 10 at the short gap discharge, the discharge firing voltage can be reduced. Additionally, the discharge efficiency may be improved by channeling the short gap discharge into the long gap of a portion of each electrode 45 and 46 that adjoins the front substrate 20.

Figure 13:
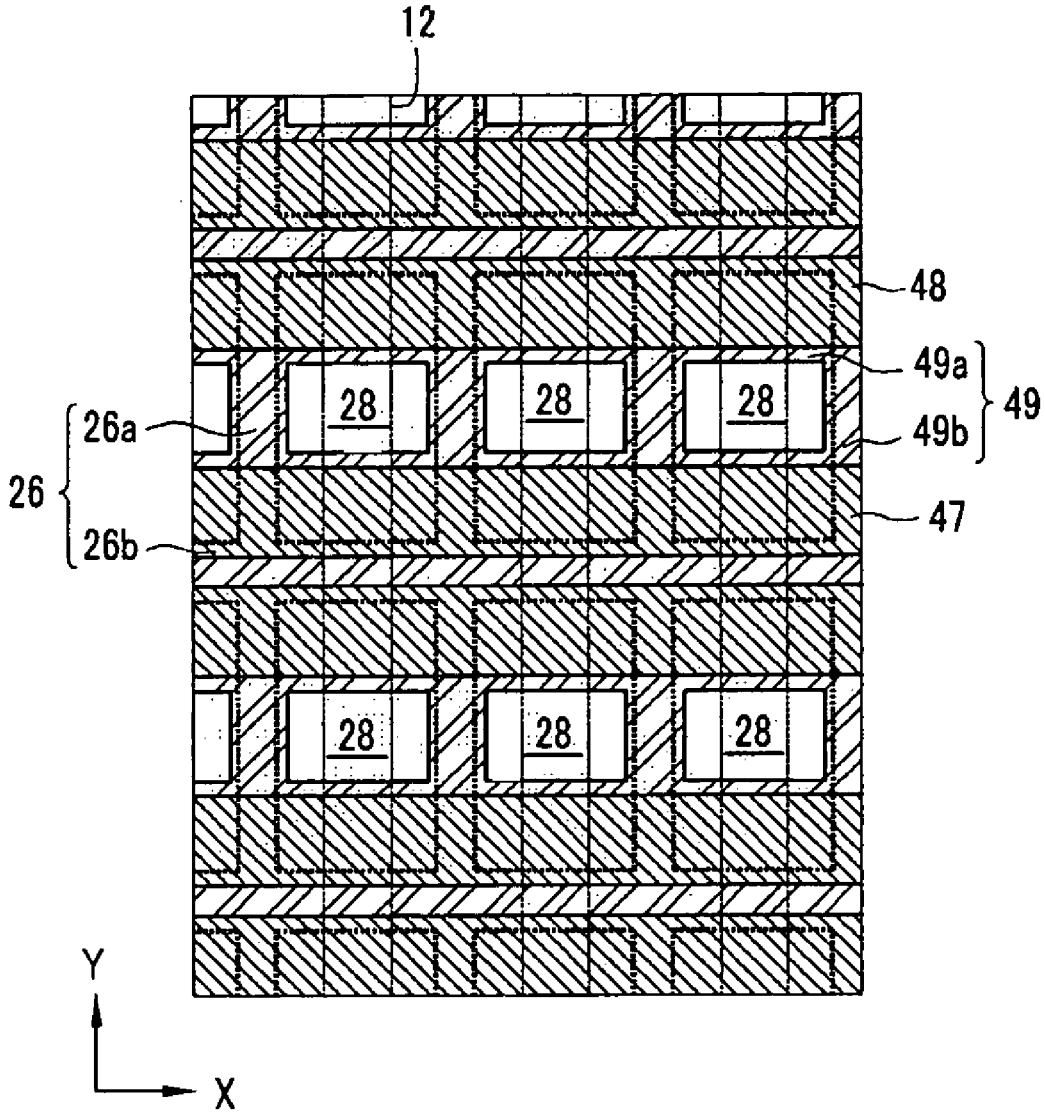
FIG. 13 is a partial plan view of a plasma display panel manufactured according to a fifth embodiment of the invention.

FIG. 13 is a partial plan view of a plasma display panel manufactured according to a fifth embodiment of the invention. As shown in FIG. 13, the first and the second electrode 47 and 48 may be formed in a stripe shape that extends in the second direction. In the present embodiment, a second dielectric layer 49 may be formed in a matrix such that the first and second electrodes 47 and 48 independently participate in the discharge of each discharge cell 28.

Thus, the second dielectric layer 49 may include a first dielectric layer portion 49*a* that surrounds the first and second electrodes 47 and 48 and is formed along the second direction. The second dielectric layer 49 may further include a second dielectric layer portion 49*b* formed along the first direction crossing the first dielectric layer 49*a* and that divides each discharge space into independent subspaces.

Since the basic structures of the second embodiment, third embodiment, fourth embodiment, and fifth embodiment of the invention may be the same or similar to those of the first embodiment of the invention, the modifications of the first embodiment can be applied to the second embodiment, third embodiment, fourth embodiment, and fifth embodiment; and these modifications are included in the scope of the invention.

The invention may use first electrodes and/or second electrodes having modifications to the structures described above. Additionally, embodiments of the invention invention may be configured that the protrusion degree of electrodes at a portion facing the front substrate differs from the protrusion degree of electrodes at a portion facing the rear substrate.

Also, although the first electrode and the second electrode have a same structure in the above-mentioned embodiments, the structure of the electrode described in the invention may be applied to any one of the first and second electrodes.

While the invention has been particularly shown and described with reference to exemplary embodiments and modifications thereof, it will be understood by those skilled in the art that various changes in form and details may be made therein without departing from the spirit and scope of the invention as defined by the appended claims.

What is claimed is:

1. A plasma display panel, comprising:

a first substrate substantially paralleling an opposite second substrate across a predetermined gap, wherein the gap includes at least one discharge cell;

a phosphor layer formed in the at least one discharge cell;

an address electrode formed on the first substrate to extend along a first direction; and a first electrode and a second electrode formed on the first substrate, wherein the first electrode and the second electrode are formed opposite to each other, and both the first electrode and the second electrode extend along a second direction that intersects—the first direction, wherein the at least one of the first electrode and the second electrode comprises a first portion and a second portion, the first portion being between the second portion and the second substrate and the second portion being between the first portion and the first substrate, and wherein the first portion protrudes a first distance toward a center of the discharge cell, and the second portion protrudes a second distance toward the center of the discharge cell, the first distance being different from the second distance.

2. The plasma display panel of claim 1, wherein the second portion of the at least one of the first electrode and the second electrode is closer to the center of the discharge cell than the first portion of the at least one of the first electrode and second electrode.

3. The plasma display panel of claim 2, wherein the second portion of the at least one of the first electrode and the second electrode is longer than the first portion of the at least one of the first electrode and second electrode in the first direction.

4. The plasma display panel of claim 2, wherein a surface of the at least one of the first electrode and the second electrode that faces the center of each discharge cell is slanted.

5. The plasma display panel of claim 4, wherein the at least one of the first electrode and the second electrode becomes gradually longer in the first direction going from the first portion toward the second portion, and wherein a height of the at least one of the first electrode and the second electrode varies across the first direction.

6. The plasma display panel of claim 4, wherein a region of the at least one of the first electrode and the second electrode that is proximate the center of the discharge cell further comprises a surface perpendicular to the first direction.

7. The plasma display panel of claim 2, wherein the second portion of at least one of the first electrode and the second electrode has a protrusion that protrudes toward the center of the discharge cell.

8. The plasma display panel of claim 2, wherein a surface of the at least one of the first electrode and the second electrode that faces the center of each discharge cell is curved.

9. The plasma display panel of claim 1, wherein the gap includes a plurality of discharge cells, and wherein the at least one of the first electrode and the second electrode is divided into segments corresponding to each discharge cell, the at least one of the first electrode and the second electrode comprising connecting portions that connect the segments in the second direction.

10. The plasma display panel of claim 9, wherein the lengths of the portions of the segments that are proximate the second substrate and the length of the portions of the segments that are proximate the first substrate are uniform in the second direction.

11. The plasma display panel of claim 1, wherein the first electrode and the second electrode are each formed in a stripe shape that extends along the second direction.

12. The plasma display panel of claim 1, further comprising:

a first dielectric layer formed to cover the address electrode on the first substrate; and a second dielectric layer that surrounds adjacent pairs of the first electrode and the second electrode that are formed on the first dielectric layer.

13. The plasma display panel of claim 12, wherein the second dielectric layer is elongated along the second direction while respectively surrounding the first electrode and the second electrode.

14. The plasma display panel of claim 12, wherein the second dielectric layer includes:

a first dielectric layer portion formed along the second direction and that respectively surrounds the first electrode and the second electrode; and a second dielectric layer portion formed along the first direction.

15. The plasma display panel of claim 1, wherein the at least one of the first electrode and the second electrode is shared by discharge cells that are adjacent to each other in the first direction.

16. The plasma display panel of claim 15, wherein each of the first electrodes and the second electrodes are shared by discharge cells that are adjacent to each other in the first direction, and the first electrodes and the second electrodes are alternately arranged in the first direction.

17. The plasma display panel of claim 1, wherein a barrier rib is formed to divide the space between the first electrode and the second electrode and the second substrate into the discharge cell.

18. The plasma display panel of claim 17, wherein a black layer is formed on the second substrate to correspond to the portion in which the barrier rib is formed.

19. The plasma display panel of claim 1, wherein the phosphor layer is formed on the second substrate.

20. The plasma display panel of claim 1, wherein the address electrode includes a protrusion extending from the each side of the address electrode, and wherein each protrusion corresponds to the space between the first electrode and the second electrode.

* * * * *